US010161024B2

(12) United States Patent
Fröhlich et al.

(10) Patent No.: US 10,161,024 B2
(45) Date of Patent: Dec. 25, 2018

(54) METHOD FOR PRODUCING AN ULTRA HIGH STRENGTH MATERIAL WITH HIGH ELONGATION

(71) Applicant: OUTOKUMPU NIROSTA GMBH, Krefeld (DE)

(72) Inventors: Thomas Fröhlich, Ratingen (DE); Marcel Hartig, Krefeld (DE); Seyed Amin Mousavi Rizi, Frechen (DE); Jochen Krautschick, Solingen (DE); Stefan Lindner, Willich (DE); Jasminko Skrlec, Duisburg (DE)

(73) Assignee: Outokumpu Nirosta GmbH, Krefeld (DE)

( * ) Notice: Subject to any disclaimer, the term of this patent is extended or adjusted under 35 U.S.C. 154(b) by 192 days.

(21) Appl. No.: 14/772,700

(22) PCT Filed: Feb. 27, 2014

(86) PCT No.: PCT/EP2014/053845

§ 371 (c)(1),
(2) Date: Sep. 3, 2015

(87) PCT Pub. No.: WO2014/135441

PCT Pub. Date: Sep. 12, 2014

(65) Prior Publication Data

US 2015/0376749 A1 Dec. 31, 2015

(30) Foreign Application Priority Data

Mar. 4, 2013 (DE) ..... 10 2013 003 516

(51) Int. Cl.

| | |
|---|---|
| ***C22C 38/38*** | (2006.01) |
| ***C22C 38/34*** | (2006.01) |
| ***C21D 9/52*** | (2006.01) |
| ***C21D 1/02*** | (2006.01) |
| ***C21D 8/02*** | (2006.01) |
| ***C21D 7/02*** | (2006.01) |
| ***C21D 6/00*** | (2006.01) |
| ***C21D 9/46*** | (2006.01) |
| ***C22C 38/04*** | (2006.01) |
| ***C22C 38/18*** | (2006.01) |
| ***C22C 30/00*** | (2006.01) |
| ***C22C 38/00*** | (2006.01) |
| ***C22C 38/02*** | (2006.01) |
| ***C22C 38/06*** | (2006.01) |

(52) U.S. Cl.

CPC ..... *C22C 38/38* (2013.01); *C21D 6/002* (2013.01); *C21D 6/005* (2013.01); *C21D 6/008* (2013.01); *C21D 8/0236* (2013.01); *C21D 8/0247* (2013.01); *C21D 8/0273* (2013.01); *C21D 9/46* (2013.01); *C21D 9/52* (2013.01); *C22C 30/00* (2013.01); *C22C 38/001* (2013.01); *C22C 38/02* (2013.01); *C22C 38/04* (2013.01); *C22C 38/06* (2013.01); *C22C 38/18* (2013.01); *C21D 2211/001* (2013.01)

(58) Field of Classification Search

None

See application file for complete search history.

(56) References Cited

U.S. PATENT DOCUMENTS

| | | | | |
|---|---|---|---|---|
| 5,431,753 | A | 7/1995 | Kim et al. | |
| 6,358,338 | B1 | 3/2002 | Guelton et al. | |
| 7,708,841 | B2 * | 5/2010 | Saller | C22C 38/58 148/327 |
| 2012/0000580 | A1 | 1/2012 | Weber et al. | |

FOREIGN PATENT DOCUMENTS

| | | |
|---|---|---|
| DE | 69226946 | 5/1999 |
| DE | 10146616 | 7/2002 |
| DE | 102010020373 | 11/2011 |
| EP | 1352982 | 10/2003 |
| WO | 2011154153 | 12/2011 |
| WO | 2012/077150 | 6/2012 |

OTHER PUBLICATIONS

PCT, International Search Report from the ISA for International Application No. PCT/EP2014/053845, dated Aug. 21, 2014, pp. 4.
PCT, International Preliminary Report on Patentability (Chapter II of the Patent Cooperation Treaty) for International Patent Application No. PCT/EP2014/053845, dated Jan. 7, 2015, pp. 8.

* cited by examiner

*Primary Examiner* — Deborah Yee
(74) *Attorney, Agent, or Firm* — Chernoff Vilhauer LLP

(57) ABSTRACT

The invention relates to a method for producing an ultra high strength material with high elongation by work hardening an essentially nickel-free austenitic material and then subjecting the material to heat treatment in the temperature range between 200° C. and <1,100° C. within a period from 10 s to 10 minutes.

9 Claims, No Drawings

METHOD FOR PRODUCING AN ULTRA HIGH STRENGTH MATERIAL WITH HIGH ELONGATION

CROSS-REFERENCE TO RELATED APPLICATIONS.

This is a national stage application filed under 35 USC 371 based on International Application No. PCT/EP2014/053845 filed Feb. 27, 2014 and claims priority under 35 USC 119 of German Patent Application No. 10 2013 003516.3 filed Mar. 4, 2013.

STATEMENT REGARDING FEDERALLY SPONSORED RESEARCH OR DEVELOPMENT

Not Applicable.

THE NAMES OF THE PARTIES TO A JOINT RESEARCH AGREEMENT Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB) Not applicable.

STATEMENT REGARDING PRIOR DISCLOSURES BY THE INVENTOR OR A JOINT INVENTOR

Not Applicable.

The invention relates to a method for producing an ultra high strength material with high elongation.

BACKGROUND OF THE INVENTION

Particularly in the vehicle building industry, metallic materials are very widely used, and vehicle manufacturers are interested to obtain improved engine performance by reducing vehicle weight and at the same time lower emissions of pollutants.

The DE 102010020373 A1 discloses a method for producing a component from a sheet of iron-manganese steel, comprising the following steps:

Cold forming a sheet metal workpiece in a pressing tool,

Heating the pressed sheet metal workpiece to a temperature between 500 and 700° C., and Calibrating the heated sheet metal workpiece in a calibrating tool.

The iron-manganese steel sheet may be a TRIP steel, a TRIP/TWIP steel, or a triplex steel. The manganese content may be between 12 and 35 weight %. The temperature during heating is set so that work hardening is reduced by at least 70%, particularly 80% in pressed lateral sections of the pressed sheet metal workpiece. The tensile strength of the calibrated sheet metal workpiece has a maximum fluctuation margin of 20%, particularly 10%, over the entire geometry thereof.

The WO 2012/077150 A2 discloses a method for manufacturing a steel having a high manganese content and with good mechanical resistance and formability. The steel has the following chemical composition: C 0.2-1.5%, Mn 10-25%, optionally Ni<2%, Al 0.001-2.0%, N<0.1%, P+Sn+Sb+As<0.2%, S+Se+Te<0.5%, and also optionally Nb+Co<1, and/or Re+W<1, the remainder being iron. In connection with a cold rolling operation, a recrystallization annealing is carried out in the temperature range between 900° C. and 1100° C. for a period between 60 and 120 seconds. Alternatively, it is also possible to carry out the recrystallization annealing in a temperature range between 700° C. and 800° C. for a period between 30 and 400 minutes.

The DE 69226946 T2 discloses a method for producing a metal plate from an austenitic steel alloy with high manganese content, comprising the following steps:

Preparing a steel slab having a defined chemical composition,

Heating the steel slab to 1100° C. to 1250° C.,

Hot rolling the steel slab in order to form a hot rolled steel plate at a hot rolling temperature from 700° C. to 1000° C., Cold rolling the hot rolled plate to create a cold rolled sheet, Annealing the cold rolled sheet at a temperature between 500° C. and 1000° C. for a period lasting from 5 seconds to 20 hours, wherein said steps result in a microstructure that consists almost 100 percent of austenite grains having a grain size <40 μm in the hot- and cold-rolled annealed metal sheet, wherein the austenite bodies form deformation twin crystals during deformation below room temperature, except for ε- and α'-martensite phases induced by tensile stress.

BRIEF SUMMARY OF THE INVENTION

The object of the invention is to provide a method for producing an ultra high strength material with high elongation, by which high mechanical properties that are introduced into the material by cold working are maintained on the one hand, and on the other hand the elongation may be increased.

This object is solved with a method for producing an ultra high strength material with high elongation by work hardening an essentially nickel-free austenitic material and then subjecting the material to heat treatment in the temperature range between 200° C. and <1,100° C. within a period from 10 s to 10 minutes.

Advantageous embodiments of the method according to the invention are described in the associated dependent process claims.

BRIEF DESCRIPTION OF THE SEVERAL VIEWS OF THE DRAWINGS

None

DETAILED DESCRIPTION OF THE INVENTION

The material is advantageously work hardened and then subjected to heat treatment in the temperature range between 200° C. and <1,100° C. within a period from 10 s to 10 minutes in order to set a yield strength $R_{p0.2}$ between 400 and 1300 MPa, a tensile strength $R_m$ between 800 and 1700 MPa and an elongation $A_{80}$ between 3 and 60%.

According to a further thought associated with the invention, the material is work hardened by cold rolling.

In this way, an annealed strip reeled into a coil may be processed in a thickness-reducing manner when needed by means of a suitable rolling apparatus.

In a subsequent step, the strip that has been work hardened in this manner is fed continuously when needed into a suitable heat treatment furnace, and undergoes heat treatment in the desired temperature range below the recrystallization temperature within a defined time window.

Unlike the processes described in the prior art, the material is not subjected to recrystallization annealing, instead the desired elongation parameters are set in the material below the recrystallization temperature by deliberate control of the temperature and time.

The material is preferably present in an annealed version. This material is then subjected to 40 to 95 percent work hardening by cold rolling.

Following the heat treatment, it was discovered that the elongation of the ultra high strength material could be increased from 15 to at least 25%, for example, in certain temperature ranges.

Particularly in the automotive industry, this material is constructed thinner in relation to hitherto used components, while at the same time still delivering the same reliability as the conventional material.

This material may be used in the motor vehicle industry (cars, trucks, buses) as well as for rail vehicles. Preferred components in this context are structural components, chassis, bodywork sheet metal parts, bodywork sheet metal elements, B-pillars, rockers or the like.

The austenitic material used is advantageously an iron-manganese steel (with or without chromium).

In the following, examples of possible material compositions are given (in % by weight):

| | | |
|---|---|---|
| 1. | Mn | 4-30% |
| | Cr | 10-30% |
| | C | <1% |
| | N | <1% |
| | Fe | remainder, including unavoidable impurities |
| 2. | Mn | >10-30% |
| | C | <1.6% |
| | N | <1% |
| | Al | <7% |
| | Si | <4% |
| | Fe | remainder, including unavoidable impurities |

According to a further thought associated with the invention, the material that is to undergo heat treatment is in the annealed condition.

Depending on the application case, heat treatment may be carried out continuously on a running strip.

Of course, the option also exists a possibility that the heat treatment is carried out discontinuously on a component that has been cut or punched out of the strip.

Good results in terms of the required substantial elongation property are achieved with heat treatment in the temperature range between 700° C. and 850° C.

Depending on the type of furnace (standard heating/induction), hold times between 10 s and 10 min may be set for the respective product.

Depending on the application case of the semiproduct that is work hardened and heat treated in this way, it may when needed be hot worked in a subsequent step immediately following the heat treatment.

The invention will be explained briefly with reference to an embodiment:

In this example, an austenitic steel as a flat product having a starting thickness of 4 mm rolled from the coil to a thickness of 1.5 mm in a cold rolling mill. The initial yield strength is increased by as much as 100% by work hardening the material, which is achieved at the expense of the elongation, however. For this reason, the work hardened material is subjected to a targeted heat treatment below the recrystallization temperature thereof. In the present example, this is to take place in a continuous pass through a furnace. The furnace should be at a temperature of 800° C. The work hardened material is passed through the furnace within a timeframe of 3 minutes.

If the work hardened semiproduct is to have an elongation $A_{80}$ of 16%, the material may have an elongation $A_{80}$ of about 27% after the heat treatment.

Alternatively, the heat treatment of the work hardened material at the given temperature and time might also be used by a hot working process.

The invention claimed is:

1. A method for producing an ultra high strength material with high elongation having the following composition (in % by weight) Mn 4-30%, Cr 10-30%, C<1.0%, N<1.0%, Al<1%, Fe remainder, including unavoidable impurities, and then subjecting the material to heat treatment below the recrystallization temperature in the temperature range between greater than 700° C. and <1,100° C. within a period from 10 s to 10 minutes, followed by subjecting the material to 40 to 95% work hardening by cold rolling.

2. A method for producing an ultra high strength material with high elongation by work hardening an austenitic material consisting of making the following composition (in % by weight) Mn>10-30%, C<1.6%, N<1.0%, Al <7%, Si>0.5-<4%, Fe remainder, including unavoidable impurities, and then subjecting the material to heat treatment below the recrystallization temperature in the temperature range between greater than 700° C. and <1,100° C. within a period from 10 s to 10 minutes.

3. The method according to claim 1, in which the austenitic material is work hardened, in order to set a yield strength $R_{p0.2}$ between 1150 and 1300 MPa, a tensile strength $R_m$ between 1100 and 1700 MPa and an elongation $A_{80}$ between 3 and 60%.

4. The method according to claim 1, characterized in that the heat treatment is carried out continuously on a running strip.

5. The method according to claim 1, characterized in that the heat treatment is carried out discontinuously on a component that has been cut or punched out of the strip.

6. The method according to claim 1, characterized in that components are cut or punched out of the work hardened strip and are hot worked in a subsequent step.

7. The method according to claim 1, characterized in that components are cut or punched out of the work hardened strip and are cold worked in a subsequent step.

8. The method according to claim 1, further including the step of using the resulting material as a component in the field of automobile and rail vehicle technology.

9. The method according to claim 8, further including the step of using the component as a bodywork sheet metal part or sheet metal stiffening element, as a structural part or as a vehicle chassis.

* * * * *